United States Patent [19]

Yant

[11] Patent Number: 4,676,689

[45] Date of Patent: Jun. 30, 1987

[54] PAVEMENT PATCHING VEHICLE

[76] Inventor: Robert M. Yant, P.O. Box 28434, Sacramento, Calif. 95828

[21] Appl. No.: 800,497

[22] Filed: Nov. 21, 1985

[51] Int. Cl.[4] ..... E01C 19/22

[52] U.S. Cl. ..... 404/110; 404/133; 404/95; 404/101; 404/109

[58] Field of Search ..... 404/101, 102, 109, 110, 404/133, 108; 188/297; 267/64.11, 64.28; 182/2, 91

[56] References Cited

U.S. PATENT DOCUMENTS

| | | | |
|---|---|---|---|
| 1,632,969 | 6/1927 | Horner et al. | 404/90 |
| 1,695,202 | 12/1928 | Newell | 404/101 |
| 1,923,678 | 8/1933 | Lowell | 404/109 X |
| 2,917,979 | 12/1959 | Dening et al. | 404/133 |
| 3,217,620 | 11/1965 | Mindrum et al. | 404/133 X |
| 3,300,202 | 1/1967 | Vinton | 267/64.11 X |
| 3,361,042 | 1/1968 | Cutler | 404/77 |
| 3,497,017 | 2/1970 | Goettl et al. | 404/102 |
| 3,498,384 | 3/1970 | Ogura | 404/102 |
| 3,625,120 | 12/1971 | Nagy | 404/107 |
| 3,841,779 | 10/1974 | Ray | 404/111 |
| 3,967,913 | 7/1976 | Gabriel | 404/109 |
| 3,989,403 | 11/1976 | Verive | 404/111 |
| 4,215,949 | 8/1980 | Gabriel | 404/110 |
| 4,557,626 | 12/1985 | McKay et al. | 404/102 X |

FOREIGN PATENT DOCUMENTS

| | | | |
|---|---|---|---|
| 2359946 | 3/1978 | France | 404/109 |
| 541915 | 3/1977 | U.S.S.R. | 404/133 |

*Primary Examiner*—James A. Leppink
*Assistant Examiner*—Matthew Smith
*Attorney, Agent, or Firm*—Townsend and Townsend

[57] ABSTRACT

A pavement patching vehicle includes an asphalt supply hopper and a distribution hopper mounted to the front of the vehicle at the end of a remotely controlled articulated arm. Asphalt is deposited into a pothole from the distribution hopper for compaction by a tamper, which is mounted to the distribution hopper by a combination tamper positioner and vibration isolator. The combination uses a specially adapted gas over hydraulic liquid in a piston and cylinder arrangement for this purpose. The articulated segments are moved through piston and cylinder drives mounted within the hollow arm segments and coupled to pivot shafts at the joints. The distribution hopper can be secured to the front of the vehicle by a support bracket on the vehicle and a pivotal support latch on the distribution hopper. An actuator bar extends from the tamper and engages a latch actuator, which extends from the support latch, when the tamper is raised. Doing so moves the latch actuator and thus rotates the support latch so the support latch engages the support bracket.

28 Claims, 10 Drawing Figures

PAVEMENT PATCHING VEHICLE

BACKGROUND OF THE INVENTION

The need for a pavement patching vehicle has been recognized for a number of years. See U.S. Pat. No. 4,215,949 to Gabriel, Jr. The Gabriel patent shows a vehicle having a supply hopper mounted along one side. The supply hopper, used to hold a quantity of asphalt, can be lowered to allow a dump truck to dump asphalt or other patching material into it through its open top. After this is done, the supply hopper is lifted to a raised position for transport and use.

The Gabriel vehicle has a distribution hopper mounted to the end of a remotely controlled arm extending from the front of the vehicle. The arm has a pair of articulated joints which allow the hopper to be positioned over a range of positions by the vehicle operator. The distribution hopper, which has an open top, is filled by placing it under the forward end of the supply hopper. The supply hopper has an auger in it which drives the asphalt forward to be discharged through a downwardly facing opening and into the underlying distribution hopper. The asphalt in the supply hopper is kept warm by the use of a flame inside the auger tube.

After being filled, the operator of the Gabriel vehicle moves the distribution hopper over an area to be repaired and remotely operates a door at the bottom of the distribution hopper, allowing a desired amount of asphalt to be deposited on the roadway. A remotely controlled tamper, mounted to the distribution hopper, tamps the asphalt in place.

SUMMARY OF THE INVENTION

The present invention is directed to an improved pavement patching vehicle of the type including a supply hopper for holding a supply of paving material, typically asphalt, and a distribution hopper mounted to the front of the vehicle at the end of an articulated arm. Movement of the arm is remotely controlled by the operator within the vehicle to allow the distribution hopper to be positioned over a pothole or other area to be repaired. A discharge opening at the bottom of the distribution hopper is temporarily opened to allow enough asphalt to be deposited in the pothole, and is then closed. All operations are controlled by the operator within the vehicle.

The distribution hopper carries with it a reciprocating tamper which compacts the asphalt. The distribution hopper preferably also carries a blower for blowing out loose debris from the pothole, a flame throwing burner for heating the surface area and incinerating any combustible material which may be left, and a tack oil sprayer used to improve the bonding of the paving material to the pavement.

The tamper is mounted to the distribution hopper through a combination tamper positioner and vibration isolator. The combination uses a specially adapted gas over hydraulic liquid in a piston and cylinder arrangement for this purpose.

The lower part of the distribution hopper preferably includes a clamshell door assembly comprising the lower sides and bottom of the distribution hopper. The door assembly includes a pair of pivotal doors which open and close to allow paving material to be deposited on the pavement surface. The articulated arm preferably includes three joints for superior maneuverability, the arm segments being moved through piston and cylinder drives mounted within the arm segments and coupled to the pivot shaft of the joint.

During travel the distribution hopper is positioned against the front of the vehicle. A hopper support bracket extends from the vehicle front and engages a support latch pivotally mounted to the distribution hopper. The support latch is pivoted between a disengaged or unlatched position and a latched position by the raising and lowering of the tamper. A latch actuator extends from the support latch and is engaged by an actuator bar extending from the tamper when the tamper is raised to its traveling position, thus automatically securely locking distribution hopper to the front of the vehicle.

A key feature of applicant's invention is the use and design of the combination positioner and isolator. The combination includes a piston and cylinder with an auxiliary chamber mounted above the upper end of the cylinder. The portion of the cylinder above the piston and the auxiliary chamber contains an incompressible liquid, such as oil, and a compressed gas, such as air, over the liquid. This provides a positive downward force on the piston of the combination, thus forcing the tamper head toward the pavement surface. Upon actuation of the tamper, upward force is exerted on the piston intermittently by the vibrating tamper head, thus tending to cyclically compress the gas in the auxiliary chamber. Thus, the gas acts as a non-mechanical spring tending to isolate the vibrating tamper from the distribution hopper. This is important because if the tamper were mounted directly to the distribution hopper, the vibration which would be transmitted to the hopper would soon cause mechanical failure of the hopper and the components mounted to the hopper.

The combination positioner and isolator also allows the user to vary the force at which the tamper head is lowered to rest against the pavement by simply changing the pressure of the air introduced into the auxiliary chamber. It has been found that the use of gas over liquid isolation, besides being much more flexible, is much more effective than is a mechanical spring mounted to the piston of a combination positioner and isolator.

The tamper has a relatively small stroke in use. However, the area to be patched may be uneven. The gas above liquid arrangement compensate for such variation in the height of the pavement surface as the distribution hopper is moved about an area by allowing the tamper to move upwardly and downwardly against the pressurized gas in the accumulator.

The invention uses three joints in its articulated arm to achieve a great deal of flexibility in positioning a distribution hopper. Also, the use of the piston and cylinder drives to rotate the arm segments and lock them in place has been found to have advantages over rotary actuators. The piston and cylinder drives result in an articulated arm which is smaller and more compact than one using rotary actuators since the piston and cylinder combinations are housed within the arms themselves. The piston and cylinder drives also provide the operator with better, more precise control compared with rotary actuators.

Other features and advantages of the invention will appear from the following description in which the preferred embodiment has been set forth in detail in conjunction with the accompanying drawings.

BRIEF DESCRIPTION OF THE DRAWINGS

FIG. 2B is a partial view taken along line 2B—2B of FIG. 2A showing the doors substantially closed while

DETAILED DESCRIPTION OF THE PREFERRED EMBODIMENT

Figure 1:
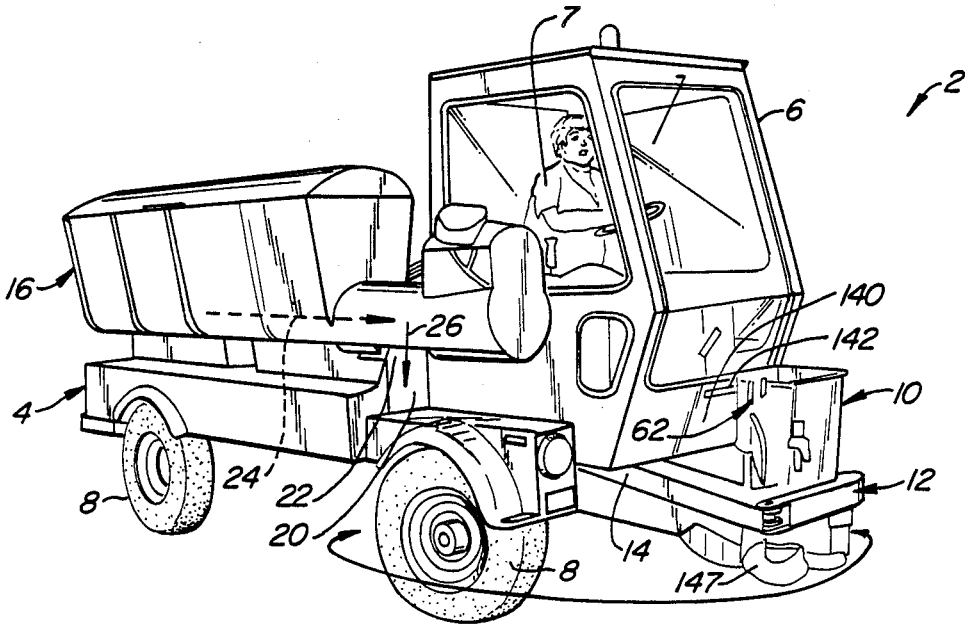
FIG. 1 is a perspective view of a pavement patching vehicle made according to the invention.

Referring now to FIG. 1, pavement patching vehicle 2 is shown to include a body 4 to which a cab 6, housing an operator 7, and tires 8 are mounted. A paving material distribution hopper 10 is mounted to the outer end of an articulating arm 12, arm 12 extending from a mounting point 14 below cab 6. A supply hopper 16 is mounted to body 4 of vehicle 2 and is used to contain a quantity of paving material 18, see FIG. 3, such as asphalt. Supply hopper 16 is used to refill distribution hopper 10 as needed. This is accomplished by the operator manipulating arm 12 so that distribution hopper moves to a reloading position 20 beneath a discharge opening 22 of supply hopper 16. Supply hopper 16 preferably uses an auger or similar means to move paving material 18 to discharge opening 22 as indicated by arrows 24, 26.

Figure 2A:
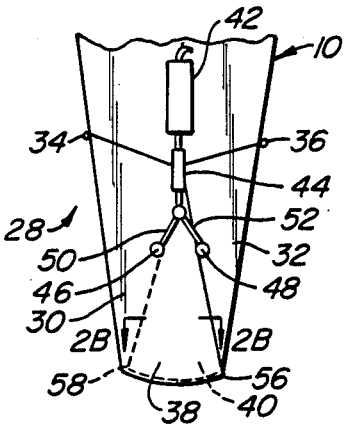
FIG. 2A is a simplified side view of the lower portion of the distribution hopper of FIG. 1 shown in a closed position.
Figure 2C:
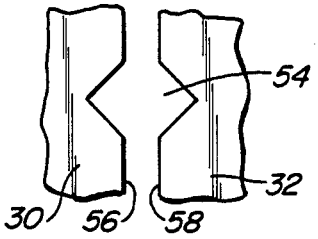
FIG. 2C shows the doors opened.
Figure 2B:
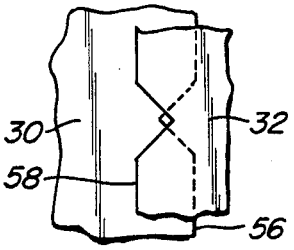

Referring now also to FIGS. 2A–2C, a clamshell door assembly 28 is seen to constitute the lower portion of distribution hopper 10. Door assembly 28 includes pivotal doors 30, 32 pivotally mounted at positions 34, 36 to the lower end of hopper 10. Portions 38, 40 of doors 30, 32 overlap when in the closed position of FIG. 2A and 2B. Doors 30, 32 are actuated by a piston and cylinder combination 42 having an adjustable length actuator rod 44 connected to pivot points 46, 48 on doors 30, 32 by toggle rods 50, 52. Movement of actuator rod 44 downwardly separates pivot points 46, 48 thus opening clamshell door assembly 28 so to create a discharge opening 54 through which paving material 18 can pass, typically for deposit in a pothole.

The size of discharge opening 54 is accurately controlled by the configuration of the leading edges 56, 58 of doors 30, 32 to define a generally triangular shape discharge opening 54 which increases in size in two dimensions over at least a portion of the movement of doors 30, 32. In the preferred embodiment this discharge opening is diamond shaped; however other shapes of gradually widening discharge openings can be used as well. Other methods for creating the paving material discharge opening may also be used.

Figure 3:
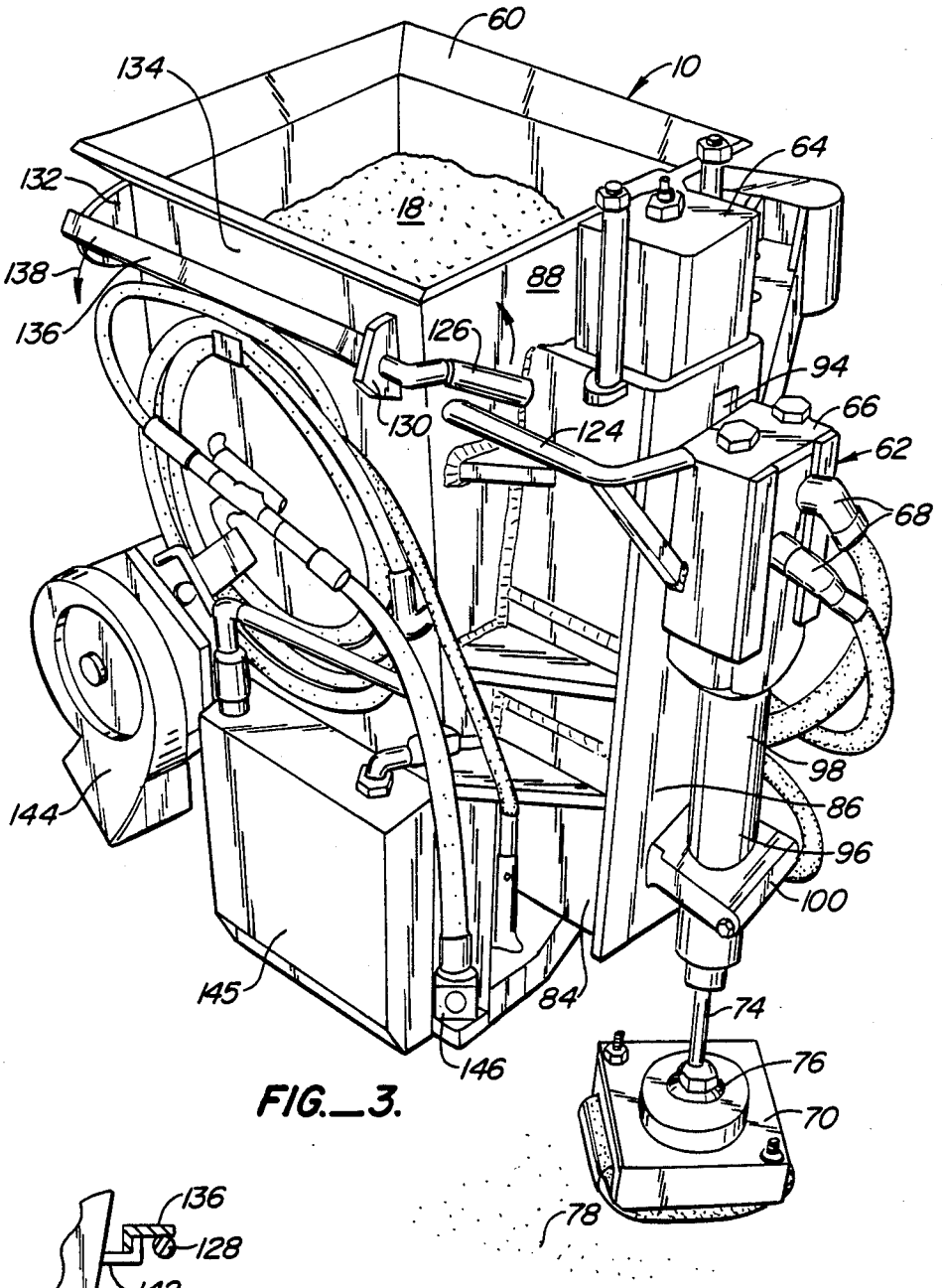
FIG. 3 is a perspective view of the distribution hopper of FIG. 1.
Figure 4:
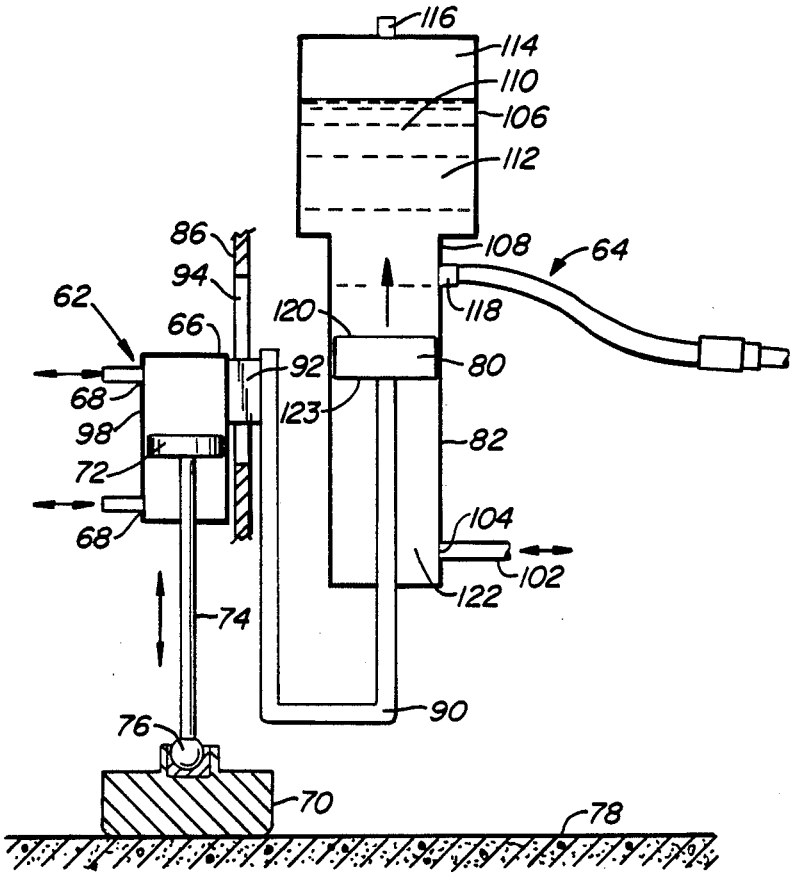
FIG. 4 is a schematic representation of the tamper and combination positioner and isolator of FIG. 3.

Referring now to FIGS. 3 and 4, distribution hopper 10 is shown having an open top 60 and containing a supply of paving material 18. A tamper 62 is mounted to distribution hopper 10 through a combination tamper positioner and isolator 64. Tamper 62 includes a hydraulic reciprocator 66 having hydraulic actuation ports 68 through which hydraulic fluid flows causing vertical vibrational movement of a tamper head 70 connected to a piston 72 through a connecting rod 74. The connection between tamper head 70 and connecting rod 74 is through a ball and socket joint 76. Joint 76 permits some angular articulation of tamper head 70 to accommodate uneven pavement surfaces 78 to reduce the chance of failure at the connection between tamper head 70 and connector rod 74.

Combination 64 includes a piston 80 housed within a cylinder 82. Cylinder 82 is housed within a mounting box 84 having a front plate 86. Mounting box 84 is welded to a side 88 of distribution hopper 10. Tamper 62 is supported by piston 80 through a generally U-shaped connection member 90. Member 90 has a horizontally extending flange portion 92 which passes through a slot 94 in front plate 86 so that reciprocator 66 lies adjacent front plate 86. A lower portion 96 (FIG. 3) of reciprocator cylinder 98 is slidably housed within a guide block 100 extending from and secured to front plate 86. Application of hydraulic fluid through hydraulic line 102 to port 104 in cylinder 82 below piston 80 raises piston 80, thus raising tamper 62.

An auxiliary chamber 106 is mounted to the upper end 108 of cylinder 82. The region 110 defined within auxiliary chamber 106 and the portion of cylinder 82 above piston 80 is partially filled with hydraulic fluid 112 over which a volume 114 of compressed gas exists. This gas over liquid condition of region 110 is accomplished by first raising piston 80 to upper end 108, removing a filler plug 116 at the top end of auxiliary chamber 106, filling or substantially filling auxiliary chamber 106 with hydraulic fluid 112, lowering piston 80, replacing filler plug 116 and then forcing compressed air through a compressed air fill port 118 to the desired pressure in gas volume 114. Thus gas volume 114 presses upon upper face 120 of piston 80 while hydraulic fluid 122 within cylinder 82 below piston 80 presses upon lower face 123. By controlling the flow of fluid through hydraulic line 102, the height of piston and thus the height of tamper 62 can be adjusted. When tamper head 70 is lowered for use, the user can position tamper head just above pavement surface 78 so no preloading of tamper head 70 against surface 78 occurs; alternatively, a greater amount of hydraulic fluid 122 can be removed through hydraulic line 102 so that prior to actuating reciprocator 66, tamper head 70 presses against surface 78, due to the force of gas volume 114, so tamper head 70 is preloaded against surface 78.

Figure 3A:
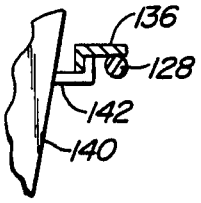
FIG. 3A is a side cross-sectional view showing the support latch of FIG. 3 engaging the support bracket of FIG. 1.

Tamper 62 has an actuator bar 124 mounted to and extending from reciprocator 66. Actuator bar 124 is positioned to engage a latch actuator 126. Actuator 126 is secured to and extends generally radially from a latch bar 128 which is pivotally supported at either end by pivot supports 130, 132 extending from a side 134 of distribution hopper 10. A support latch 136, formed from a length of angle iron, is welded to latch bar 128 and thus moves with latch bar 128 when actuator bar 124 contacts latch actuator 126 thus pivoting support latch 136 in the direction of arrow 138. When properly positioned adjacent the front end 140 of cab 6, support latch 136 engages a support bracket 142 mounted to front end 140. See FIGS. 1 and 3A. Thus, to secure distribution hopper to cab 6 while traveling or while in storage, the user manipulates articulated arm 12 until support latch 136 is adjacent support bracket 142. Tamper 62 is then raised completely to cause actuator bar 124 to engage latch actuator 126 thus rotating support latch 136 in the direction of arrow 138 to engage support bracket 142. By properly positioning and sizing support latch 136 and support bracket 142, some of the weight of distribution hopper 10 and the various components mounted to it can be removed from arm 12.

Other remotely actuated operational components are mounted to hopper 10. These include a blower 144, used to blow debris from the pothole or other surface to be patched, a tack oil sprayer 146, used to spray tack oil on surface 78 and on paving material 18 deposited on surface 78 to provide for a better bond, and a flame throwing burner 145. Burner 145 can be used to incinerate organic matter which remains on surface 78. It is, however, primarily used to heat surface 78 and the tack oil and paving material 18 deposited thereon for better adhesion. If desired, other devices, such as a rake, can be mounted to distribution hopper 10. The various electric and hydraulic control and power lines are supported between body 4 and hopper 10 by a large diameter flexible hose 147 suspended from arm 12.

Figure 5:
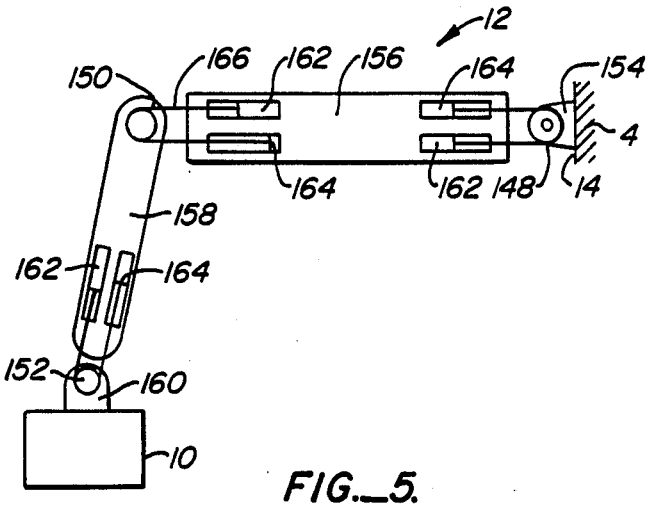
FIG. 5 is a top schematic view of the articulated arm of FIG. 1.
Figure 6:
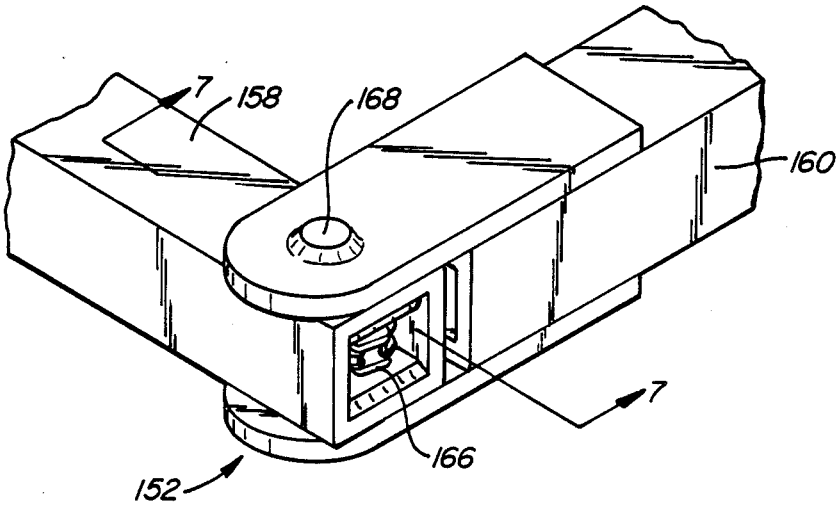
FIG. 6 is an enlarged view of the wrist joint of the arm of FIG. 1.
Figure 7:
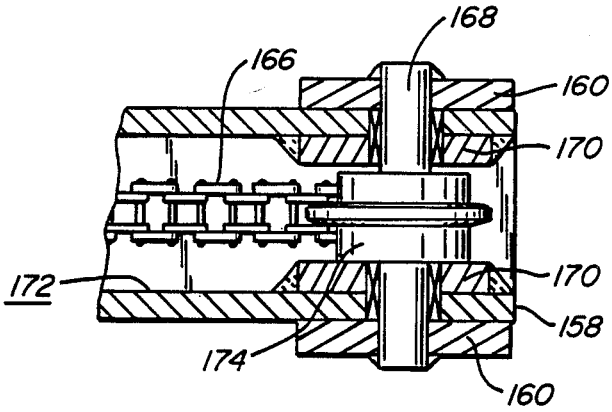
FIG. 7 is a cross-sectional view taken along line 7—7 of FIG. 6.

Turning now also to FIGS. 5, 6 and 7, articulated arm 12 will be described in more detail. Arm 12 includes a shoulder joint 148, an elbow joint 150 and a wrist joint 152 connecting various arm segments. Shoulder joint 148 connects an inner arm segment 154, which is rigidly affixed to body 4 at mounting point 14, and a first intermediate arm segment 156. Elbow joint 150 connects arm segment 156 with a second intermediate arm segment 158 while wrist joint 152 connects arm segment 158 with an outer arm segment 160, segment 160 being welded to distribution hopper 10. Note that inner and outer arm segments 154, 160 are quite short and could be made integral parts of body 4 or distribution hopper 10 respectively.

Intermediate arm segments 156, 158 are both made from square steel tubing and are sized to house pairs of piston and cylinder combinations 162, 164. Combinations 162, 164 drive chains 166. Each chain 166 passes about a pivot shaft 168 at each joint 148, 150, 152. Referring now to FIG. 6 and using wrist joint 152 as an example, it is seen that pivot shaft 168 is rigidly secured to outer arm segment 160, such as by welding. However, pivot shaft 168 and outer arm segment 160 are free to pivot relative to arm segment 158 and the strengthening plates 170 welded to the inside surface 172 of segment 158. The central portion 174 of pivot shaft 168 is enlarged and has chain 166 wrapped about it. So that movement of chain 166 drives pivot shaft 168, chain 166 is staked to the pivot shaft, typically using a bolt, not shown, passing through chain 166 and into pivot shaft 168. This of course limits the pivotal movement of shaft 168 to about 180°. However, this has not been found to be a problem. If desired, central portion 174 could be formed as a gear to engage chain 166 to eliminate the need for staking chain 166 to pivot shaft 168 so to extend the pivotal range of joint 152.

In use, operator 7, after arrival at a spot requiring work, lowers tamper 62 a short distance so to allow support latch 136 to disengage from support bracket 142. This occurs due to the weight of latch actuator 126. Distribution hopper 10 is then moved by the manipulation of arm 12 so that open top 60 underlies discharge opening 22. A supply of paving material 18 is then deposited into distribution hopper 10. Once again articulated arm 12 is manipulated to properly position distribution hopper 10, typically over a pothole. Blower 144 is actuated to blow most of the loose debris. Burner 145 is used to burn any remaining combustible material and to heat surface 78. Tack oil is then sprayed through tack oil sprayer 146 and burner 145 is again ignited to heat the tack oil. Paving material 18 is then discharged through discharge opening 54 by opening and closing clamshell door assembly 28. Tamper 62 is then lowered to its operational position and reciprocator 66 is actuated causing tamper head 70 to tamp paving material 18 in place. According to the circumstances, a series of applications of heat, tack oil and tamping can be used to provide the best patch. It should be noted that operator 7 can control everything from within cab 6. This allows a pothole to be patched by one person very quickly with very little regard to weather conditions.

Modification and variation can be made to the disclosed embodiment without departing from the subject of the invention as defined in the following claims.

I claim:

1. An improved pavement patching vehicle of the type including a supply hopper for holding a supply of paving material, the improvement comprising:

a distribution hopper including a fill opening and a movable door for selectively creating a discharge opening for the passage of paving material therethrough;

an articulated arm having arm segments for supportably mounting the distribution hopper to the vehicle, the arm including arm segments and a plurality of joints coupling the arm segments;

a tamper, including a tamper head connected to a reciprocator, mounted to the distribution hopper for tamping the paving material deposited on a surface through the discharge opening formed by the door;

means for positioning the tamper at raised and lowered positions;

a support bracket secured to the vehicle;

a support latch, movable between latched and unlatched positions, mounted to the distribution hopper, the support latch configured to engage the support bracket when positioned adjacent thereto, the support latch biased to its unlatched position; and means for moving the support latch to its latched position in response to the tamper being positioned in its raised position.

2. The vehicle of claim 1 wherein the fill opening of the distribution hopper is defined by an open top.

3. The vehicle of claim 1 wherein the door includes pivotal elements movable between opened and closed positions.

4. The vehicle of claim 3 wherein the pivotal elements include means for changing the size of the discharge opening in at least two directions during at least a portion of the movement of the pivotal elements between the opened and closed positions.

5. The vehicle of claim 4 wherein the discharge opening is generally diamond shaped during at least a part of the pivotal movement of the pivotal elements.

6. The vehicle of claim 1 further comprising a heater, mounted to the distribution hopper, for heating a region beneath the distribution hopper.

7. The vehicle of claim 1 further comprising a tack oil sprayer, mounted to the distribution hopper, for spraying tack oil at an area below the distribution hopper.

8. The vehicle of claim 1 further comprising a blower, mounted to the distribution hopper, for blowing air towards an area below the distribution hopper.

9. The vehicle of claim 1 wherein the articulated arm joints include a shoulder joint adjacent the vehicle, a wrist joint adjacent the distribution hopper, and an elbow joint therebetween.

10. The vehicle of claim 9 wherein the articulated arm segments include an inner arm segment between the vehicle and the shoulder joint, a first intermediate arm segment between the shoulder and elbow joints, a second intermediate arm segment between the elbow and wrist joints, and an outer arm segment between the wrist joint and the distribution hopper.

11. The vehicle of claim 1 wherein the articulated arm includes a piston and cylinder drive connected to at least one of the joints by a flexible drive member so that actuation of the piston and cylinder drive causes relative pivotal movement between arm segments adjacent the at least one joint.

12. The vehicle of claim 10 wherein the at least one joint includes a pivot shaft fixed to one of said adjacent arm segments and rotatably secured to the other of said adjacent arm segments, the flexible drive connected to the pivot shaft.

13. The vehicle of claim 12 wherein the flexible drive member is a chain.

14. The vehicle of claim 11 wherein the piston and cylinder drive includes first and second piston and cylinder combinations connected to the flexible drive member.

15. The vehicle of claim 11 wherein at least one of the arm segments houses the piston and cylinder drive.

16. The vehicle of claim 1 wherein the reciprocator includes a piston and cylinder, the piston connected to the tamper head by a connecting rod.

17. The vehicle of claim 1 wherein the tamper head is connected to the reciprocator through a spherical ball and socket connection to accommodate slight irregularities in the surface to be patched.

18. The vehicle of claim 1 further comprising combination means for positioning the tamper at raised and lowered positions and isolatingly mounting the tamper to the hopper.

19. The vehicle of claim 18 wherein the combination means includes a cylinder and piston, the piston connected to the tamper so that movement of the combination means piston raises and lowers the tamper.

20. The vehicle of claim 19 wherein the combination means cylinder includes an upper portion containing a gas under pressure which acts as a shock absorber for forces exerted on the combination means by the tamper.

21. The vehicle of claim 20 wherein the upper portion includes an auxiliary chamber.

22. The vehicle of claim 20 wherein the combination means cylinder includes a lower portion containing a liquid below the pressurized gas in the upper portion.

23. The vehicle of claim 21 wherein the upper portion includes a sealable opening for introducing the liquid into the upper portion.

24. The vehicle of claim 20 including means for introducing the pressurized gas into the upper portion.

25. The vehicle of claim 24 including means for introducing a liquid into the upper portion and a port for providing a pressurized liquid to the combination means cylinder below the piston so to raise and lower the tamper assembly.

26. The vehicle of claim 1 wherein the support latch moving means includes:

an actuator bar secured to and extending from the tamper; and a latch actuator coupled to the support latch so movement of the latch actuator moves the support latch between the latched and unlatched positions, the actuator bar and latch actuator being configured to contact one another as the tamper is raised from its lowered position to its raised position thereby moving the support latch to its latched position to engage the support bracket.

27. An improved pavement patching vehicle of the type including a supply hopper, mounted to the vehicle body, for holding a supply of paving material, the improvement comprising:

a distribution hopper including a fill opening and a door for selectively creating a discharge opening for the passage of paving material therethrough;

an articulated arm for supportably mounting the distribution hopper to the vehicle, the arm including arm segments and a plurality of joints coupling the arm segment, the joints each including a pivot shaft fixed to one, adjacent arm segment and rotatably secured to another, adjacent arm segment;

piston and cylinder drives connected to the pivot shafts by flexible drive members so that actuation of the piston and cylinder drives cause relative pivotal movement between arm segments;

a tamper, including a tamper head connected to a reciprocator, mounted to the distribution hopper for tamping the paving material deposited on a surface through the discharge opening formed by the door;

means for positioning the tamper at raised and lowered positions, including a cylinder and piston, the piston connected to the tamper for support of the tamper, a portion of the cylinder above the piston containing a gas under pressure;

a support bracket secured to the vehicle;

a support latch, movable between latched and unlatched positions, mounted to the distribution hopper, the support latch configured to engage the support bracket when positioned adjacent thereto, the support latch biased to its unlatched position;

an actuator bar secured to and extending from the tamper;

a latch actuator coupled to the support latch so movement of the latch actuator moves the support latch between the latched and unlatched positions; and the actuator bar and latch actuator being configured to contact one another as the tamper is raised from its lowered position to its raised position thereby moving the support latch to its latched position to engage the support bracket.

28. An improved pavement patching vehicle of the type including a supply hopper for holding a supply of paving material, the improvement comprising:

a distribution hopper including a fill opening and a discharge opening for the passage of paving material therethrough;

an articulated arm for supportably mounting the distribution hopper to the vehicle;

a tamper mounted to the distribution hopper for tamping the paving material deposited on a surface through the discharge opening;

means for positioning the tamper at raised and lowered positions;

a support bracket secured to the vehicle;

a support latch, movable between latched and unlatched positions, mounted to the distribution hopper, the support latch configured to engage the support bracket when positioned adjacent thereto, the support latch biased to its unlatched position; and means for moving the support latch to its latched position in response to the tamper being positioned in its raised position.

* * * * *